US005906370A

United States Patent [19]

Poisson

[11] Patent Number: 5,906,370

[45] Date of Patent: May 25, 1999

[54] METHOD OF PLAYING A SOCCER BOARD GAME

[75] Inventor: Renald Poisson, Houston, Tex.

[73] Assignee: Clutchability, L.L.C., Houston, Tex.

[21] Appl. No.: 08/689,919

[22] Filed: Aug. 16, 1996

[51] Int. Cl.[6] ..... A63F 3/00

[52] U.S. Cl. ..... 273/247

[58] Field of Search ..... 273/247

[56] References Cited

FOREIGN PATENT DOCUMENTS

| | | | |
|---|---|---|---|
| 2329312 | 5/1977 | France | 273/247 |
| 266130 | 1/1950 | Switzerland | 273/247 |
| 281160 | 2/1952 | Switzerland | 273/247 |
| 207360 | 11/1923 | United Kingdom | 273/247 |
| 490314 | 8/1938 | United Kingdom | 273/247 |

*Primary Examiner*—Benjamin H. Layno
*Attorney, Agent, or Firm*—John R Casperson; Cynthia G. Seal

[57] ABSTRACT

A method for playing a soccer card game. The method includes, providing a deck of kicking cards and a deck of playing cards. At least a portion of the kicking deck and the playing deck carries instructions for their use in the progress of a soccer game. A a like plurality of cards are dealt from the playing deck to each of two players. A an offense player and a defense player are declared by a coin toss or other means. The plurality of cards dealt to the offense player are an offense playing hand and the plurality of cards dealt to the defense player are a defense playing hand. A game system is also provided. The system includes a soccer game board having a representation of a soccer field thereon including a center field area, two scoring areas, and a plurality of playing positions. Each of the plurality of playing positions are connected to other of the playing positions by a plurality of connecting lines. Any two playing positions are connected only by a single line. A game piece is provided representing the defense team. The defense team game piece is used to block the offense player's pass or kick moves. A game piece representing a game ball is provided. A tabular means for recording points and penalties made by the defense player and the offense player is also used. The system also includes a deck of kicking cards and a deck of playing cards. At least a portion of the kicking deck and the playing deck carries instructions for their use in the progress of a soccer game.

27 Claims, 8 Drawing Sheets

METHOD OF PLAYING A SOCCER BOARD GAME

BACKGROUND OF THE INVENTION

This invention relates to a soccer board game. More specifically, this invention relates to a soccer board game that closely follows how professional soccer games are played.

OBJECTS OF THE INVENTION

It is an object of the present invention to provide a soccer board game that is similar to the major league game of soccer that can be played in an intimate setting.

It is another object of the present invention to provide a soccer board game that incorporates the key elements of popular card games like; the finesse of bridge, the bluffing of poker, the card counting concept of pinnocle, and the confrontation of battle or war.

It is another object of the present invention to provide a board game that is self-sustaining in that the game uses no dice, spinners, statistics or mechanical devices to depict the outcome of the game.

SUMMARY OF THE INVENTION

In one embodiment of the present invention, there is provided a method for playing a soccer card game. The method includes, providing a deck of kicking cards and a deck of playing cards. At least a portion of the kicking deck and the playing deck carries instructions for their use in the progress of a soccer game. A like plurality of cards are dealt from the playing deck to each of two players. An offense player and a defense player are declared by a coin toss or other means. The plurality of cards dealt to the offense player are an offense playing hand and the plurality of cards dealt to the defense player are a defense playing hand.

The plurality of kicking cards are selected from the group consisting of: penalty kick good, penalty kick no good, direct free kick good, indirect free kick good, direct free kick no good, indirect free kick no good, goal kick, and corner kick. The playing deck has penalty cards, offense playing cards, and defense playing cards.

The penalty cards are selected from the group consisting of: kicking an opponent, tripping an opponent, jumping an opponent, charging an opponent, striking an opponent, holding an opponent, pushing an opponent, violently charging, dangerous play, charging an opponent, obstruction, charging goal keeper, time-wasting by goal keeper, goal keeper taking more than four steps, deliberately kicking ball to his goal keeper, and kicking the ball away after award of free kick.

The offense playing cards are selected from the group consisting of: kick-off, dribble, chest pass, chip pass, head pass, heel pass, crossfield pass, square pass, and swerve pass.

The defense playing cards are selected from the group consisting of kick-off intercepted, dribble intercepted, chest pass intercepted, chip pass intercepted, head pass stopped, heel pass intercepted, crossfield pass intercepted, square pass intercepted, swerve pass intercepted.

To begin the game, a card is selected from the group consisting of a kick-off card and a dribble card from the offense playing hand. A dribble card is played when there are no kick-off cards in the offense playing hand. The offense player then draws a replacement card from the playing deck.

In another embodiment, there is provided a game system. The system includes a soccer game board having a representation of a soccer field thereon including a center field area, two scoring areas, and a plurality of playing positions. Each of the plurality of playing positions are connected to other of the playing positions by a plurality of connecting lines. Any two playing positions are connected only by a single line. The plurality of connecting lines represent passing lanes. Two game pieces are provided representing the respective goal keepers. The defense team game piece is used to block the offense player's pass or kick moves. A game piece representing a game ball is provided. A tabular means for recording points and penalties made by the defense player and the offense player is also used. The system also includes a deck of kicking cards and a deck of playing cards. At least a portion of the kicking deck and the playing deck carries instructions for their use in the progress of a soccer game. Preferably, the plurality of kicking cards and penalty cards are selected from the groups of cards outlined above.

BRIEF DESCRIPTION OF THE DRAWINGS

FIG. 6*a* is a top view of the penalty cards and is a continuation of FIG. 6.

DETAILED DESCRIPTION OF THE PREFERRED EMBODIMENTS

Figure 1:
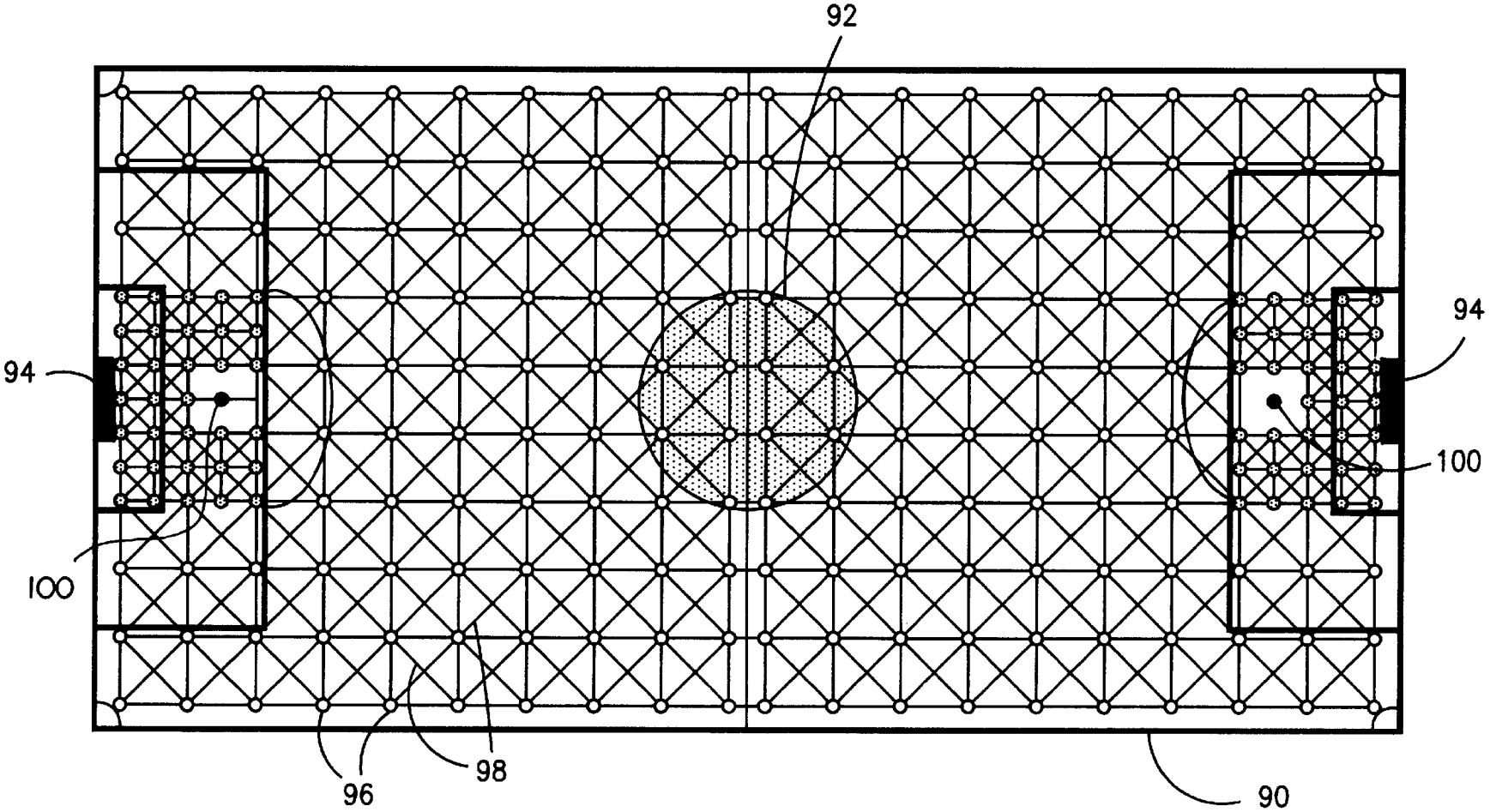
FIG. 1 is a top view of the soccer board used in the game.

In one embodiment of the present invention, there is provided a method for playing a soccer card game. The method includes, providing a deck of kicking cards 2 and a deck of playing cards 4. (See FIGS. 5–8). At least a portion of the kicking deck 2 and the playing deck 4 carries instructions for their use in the progress of a soccer game. A like plurality of cards are dealt from the playing deck 4 to each of two players. A offense player and a defense player are declared by a coin toss or other means. The plurality of cards dealt to the offense player are an offense playing hand and the plurality of cards dealt to the defense player are a defense playing hand.

The plurality of kicking cards 2 are selected from the group consisting of: penalty kick good 6, penalty kick no good 8, direct free kick good 10, indirect free kick good 12, direct free kick no good 14, indirect free kick no good 16, goal kick 18, and corner kick 20. (See FIG. 5) The playing deck 4 has penalty cards, offense playing cards, and defense playing cards.

The penalty cards are selected from the group consisting of: kicking an opponent 22, tripping an opponent 24, jumping an opponent 26, charging an opponent 28, striking an opponent 30, holding an opponent 32, pushing an opponent 34, violently charging 36, dangerous play 38, charging an opponent 40, obstruction 42, charging goal keeper 44, time-wasting by goal keeper 46, goal keeper taking more than four steps 48, deliberately kicking ball to his goal keeper 50, and kicking the ball away after award of free kick 52. (See FIG. 6)

The offense playing cards are selected from the group consisting of: kick-off 54, dribble 56, chest pass 58, chip pass 60, head pass 62, heel pass 64, crossfield pass 66, square pass 68, and swerve pass 70. (See FIG. 7)

The defense playing cards are selected from the group consisting of: kick-off intercepted 72, dribble intercepted 74, chest pass intercepted 76, chip pass intercepted 78, head pass stopped 80, heel pass intercepted 82, crossfield pass intercepted 84, square pass intercepted 86, swerve pass intercepted 88. (See FIG. 8)

To begin the game, a card is selected from the group consisting of a kick-off 54 card and a dribble 56 card from the offense playing hand. A dribble 56 card is played when there are no kick-off 54 cards in the offense playing hand. The offense player then draws a replacement card from the playing deck.

Figure 2:
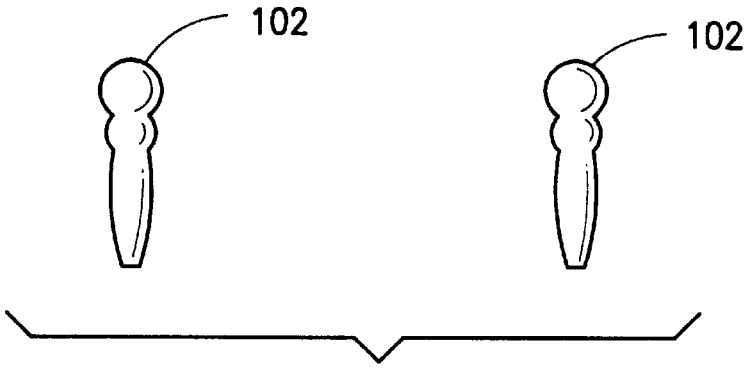
FIG. 2 is a pictorial view of a game piece.
Figure 3:
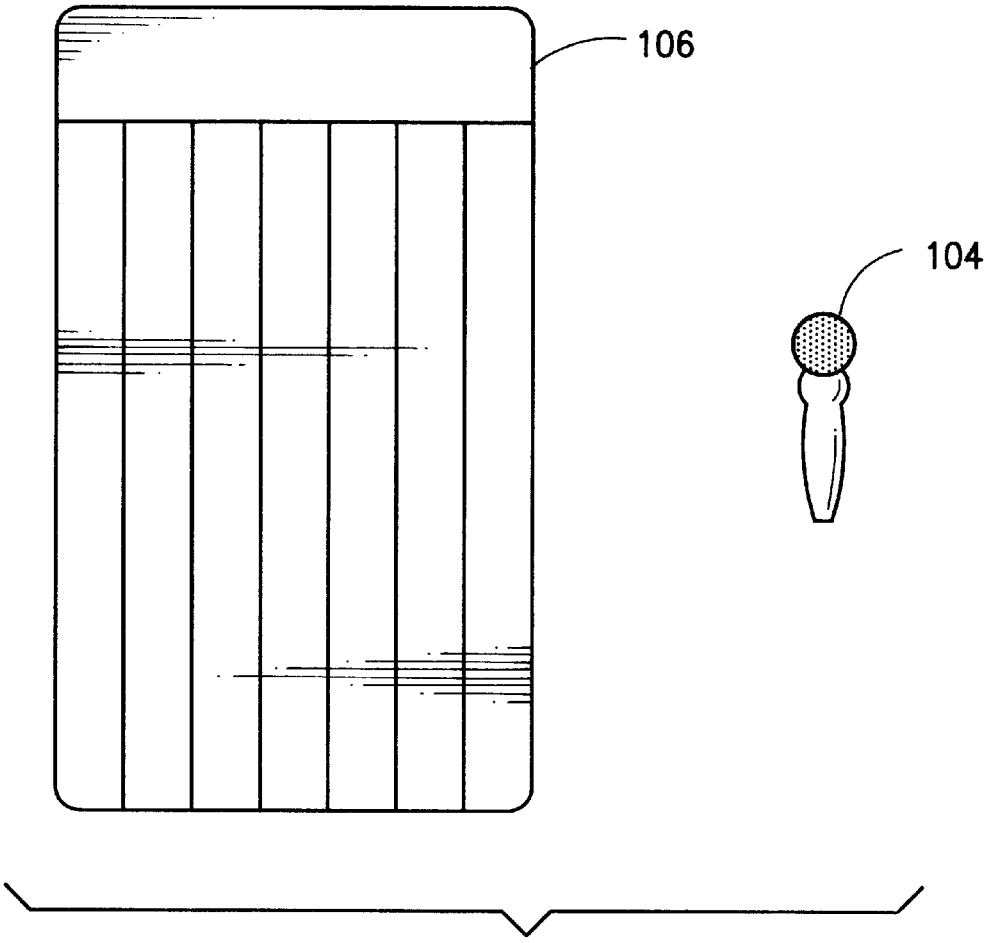
FIG. 3 is a pictorial view of a game piece representing the game ball and a tabular means.
Figure 4:
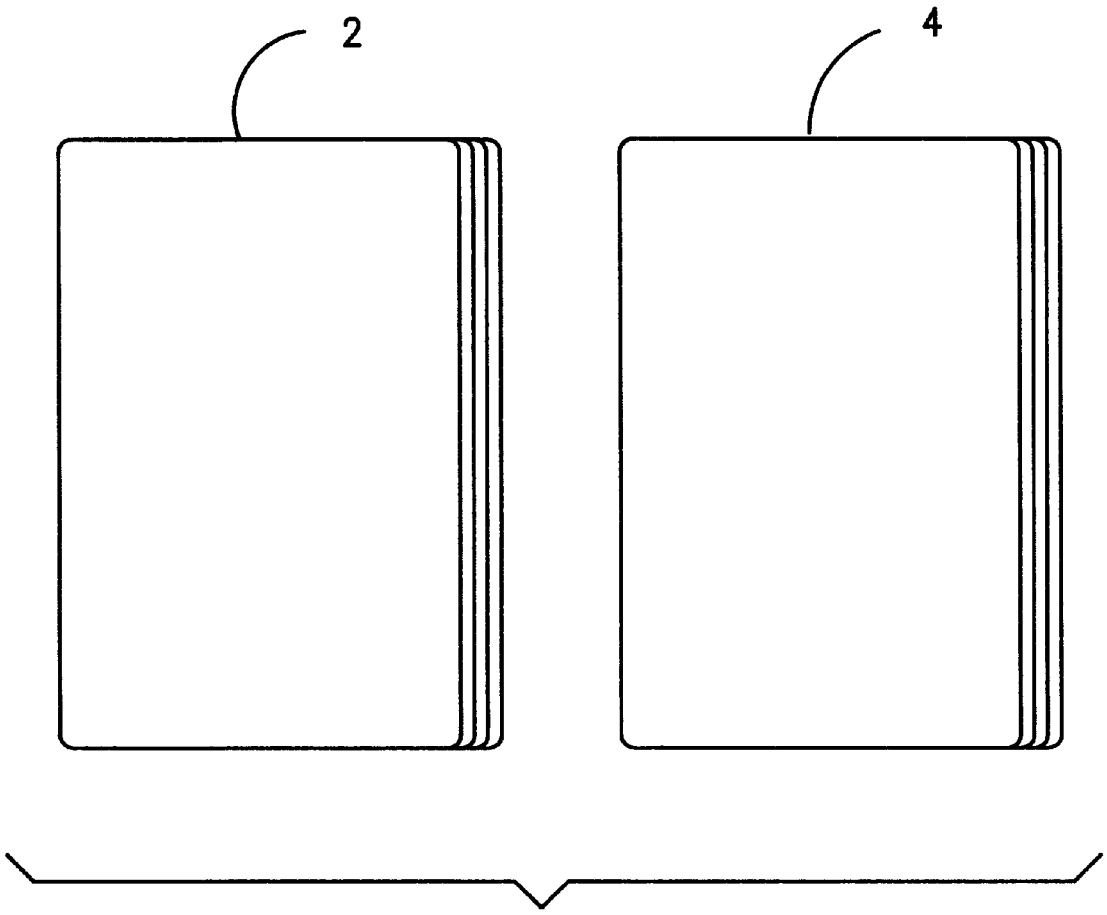
FIG. 4 is a pictorial view of various playing decks used in the game.
Figure 5:
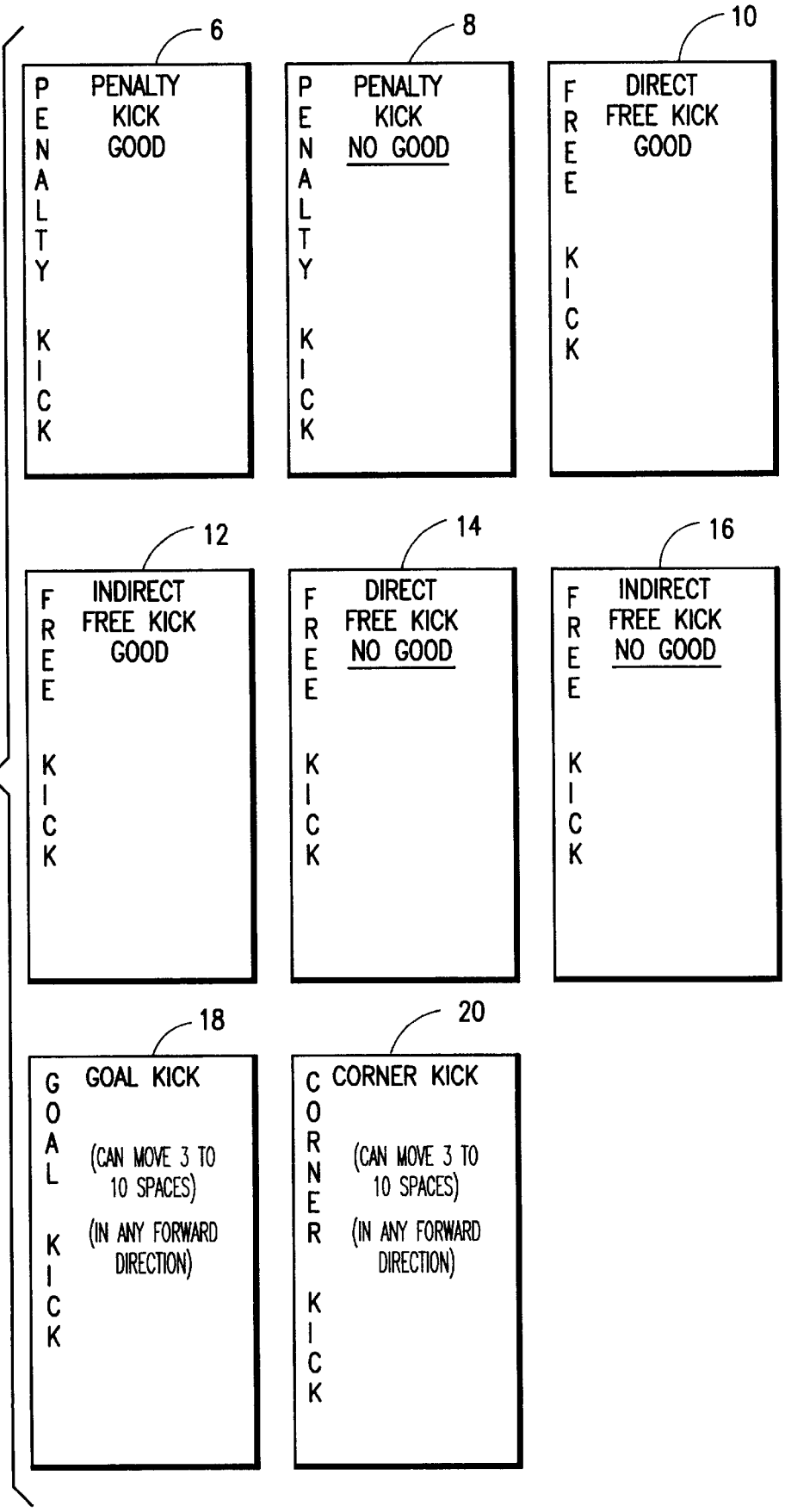
FIG. 5 is a top view of the kicking cards.
Figure 6:
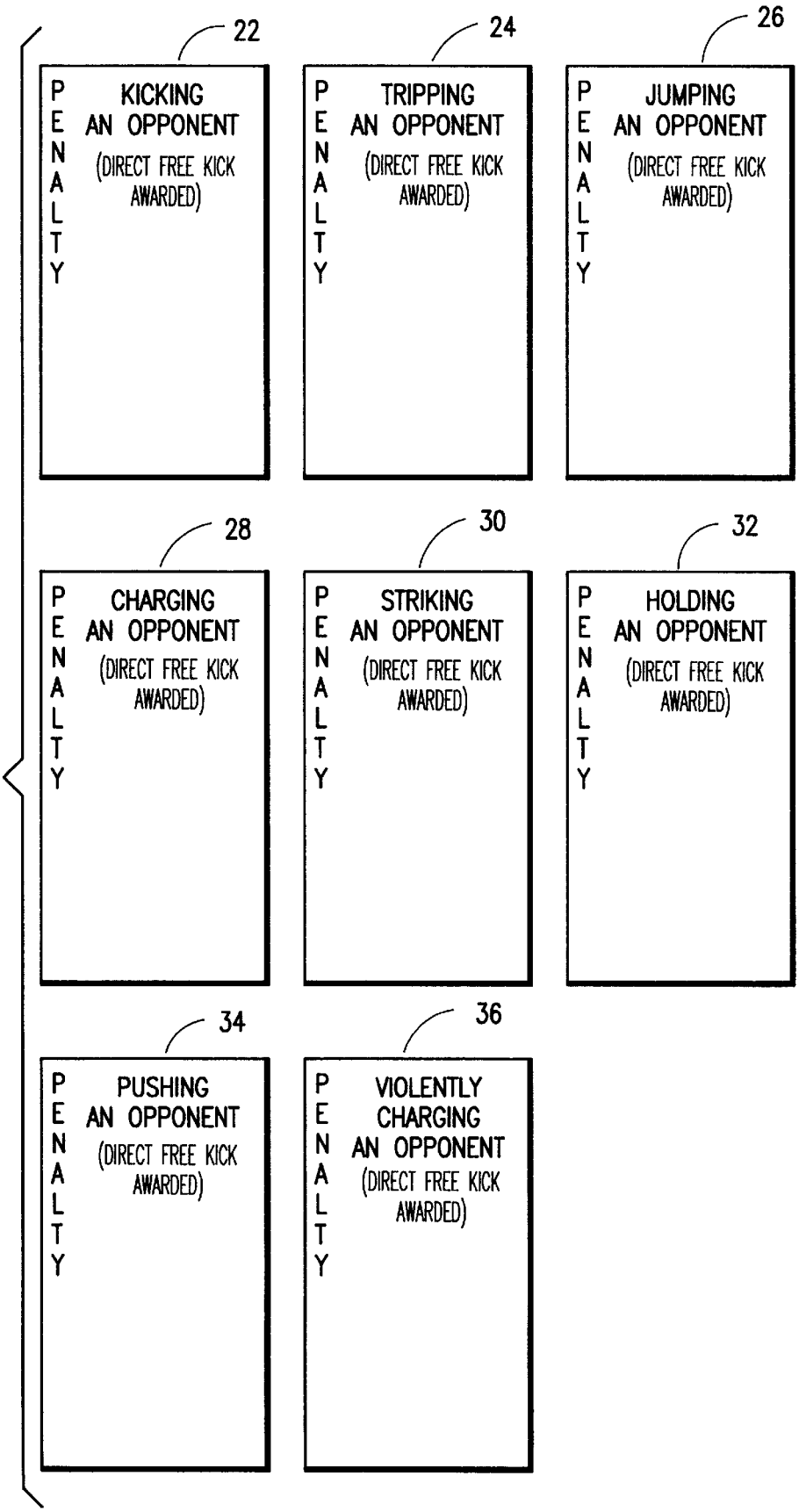
FIG. 6 and FIG. 6*a* is a top view of the penalty cards.
Figure 6A:
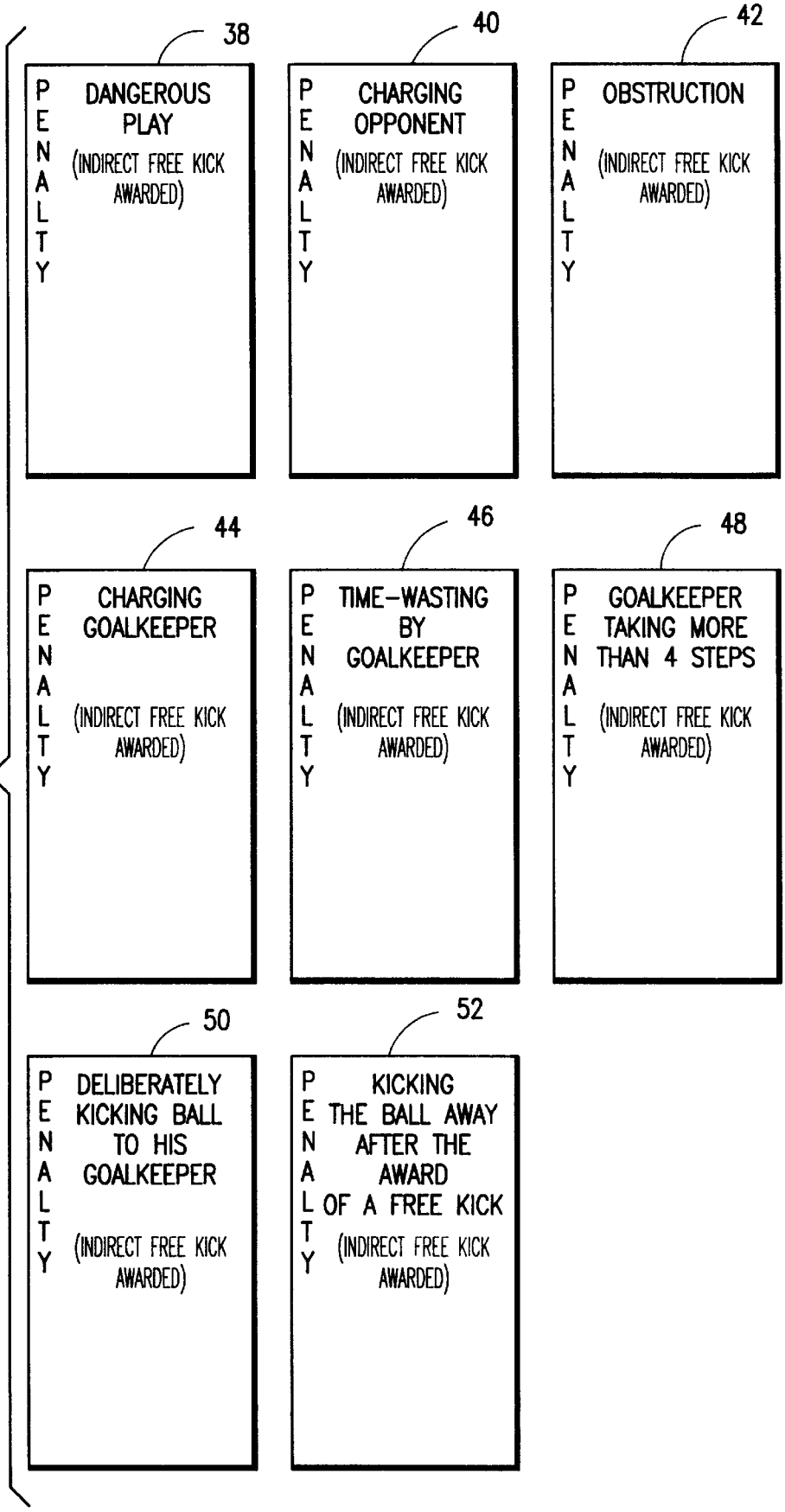
Figure 7:
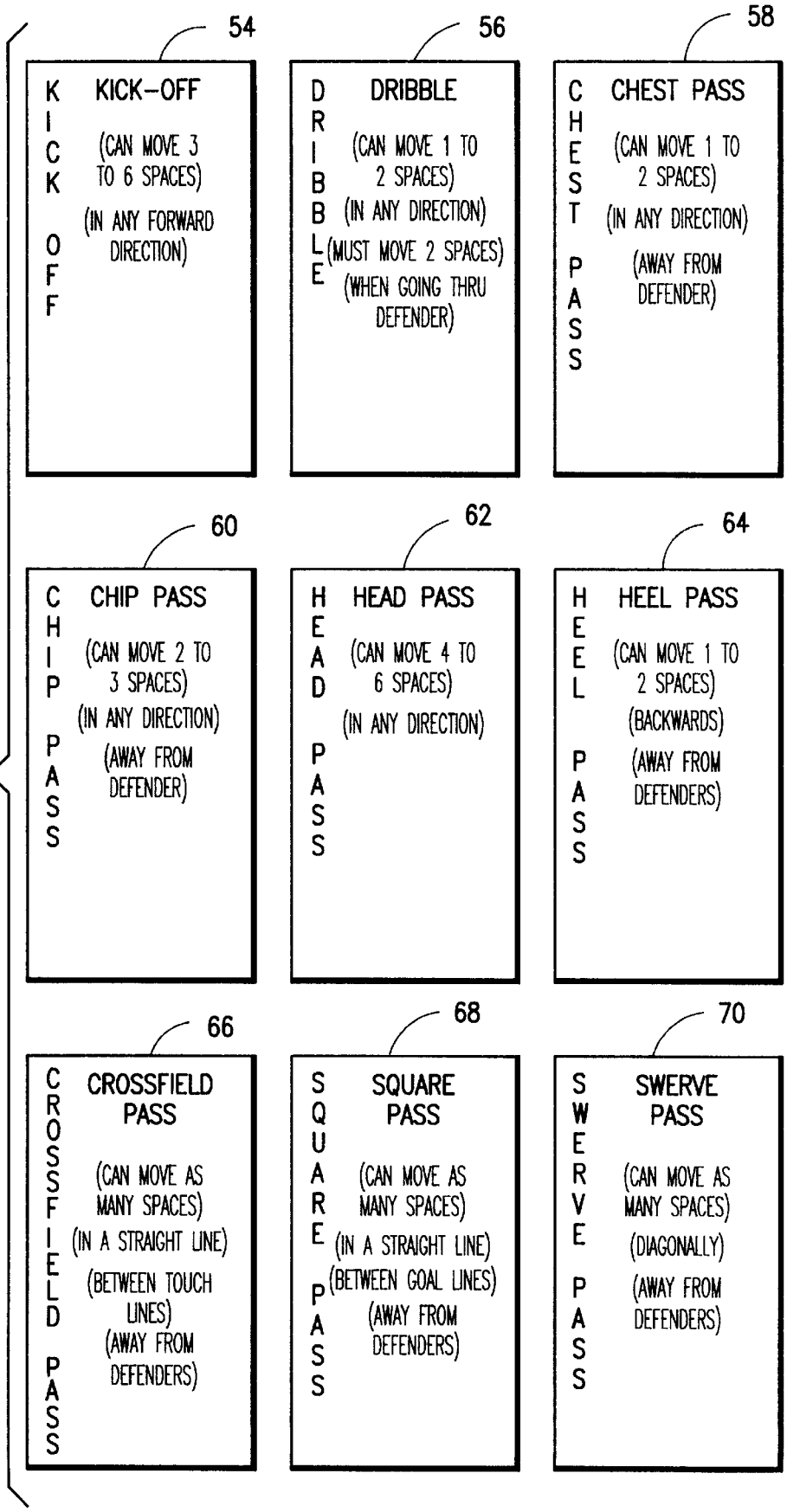
FIG. 7 is a top view of the offense cards.
Figure 8:
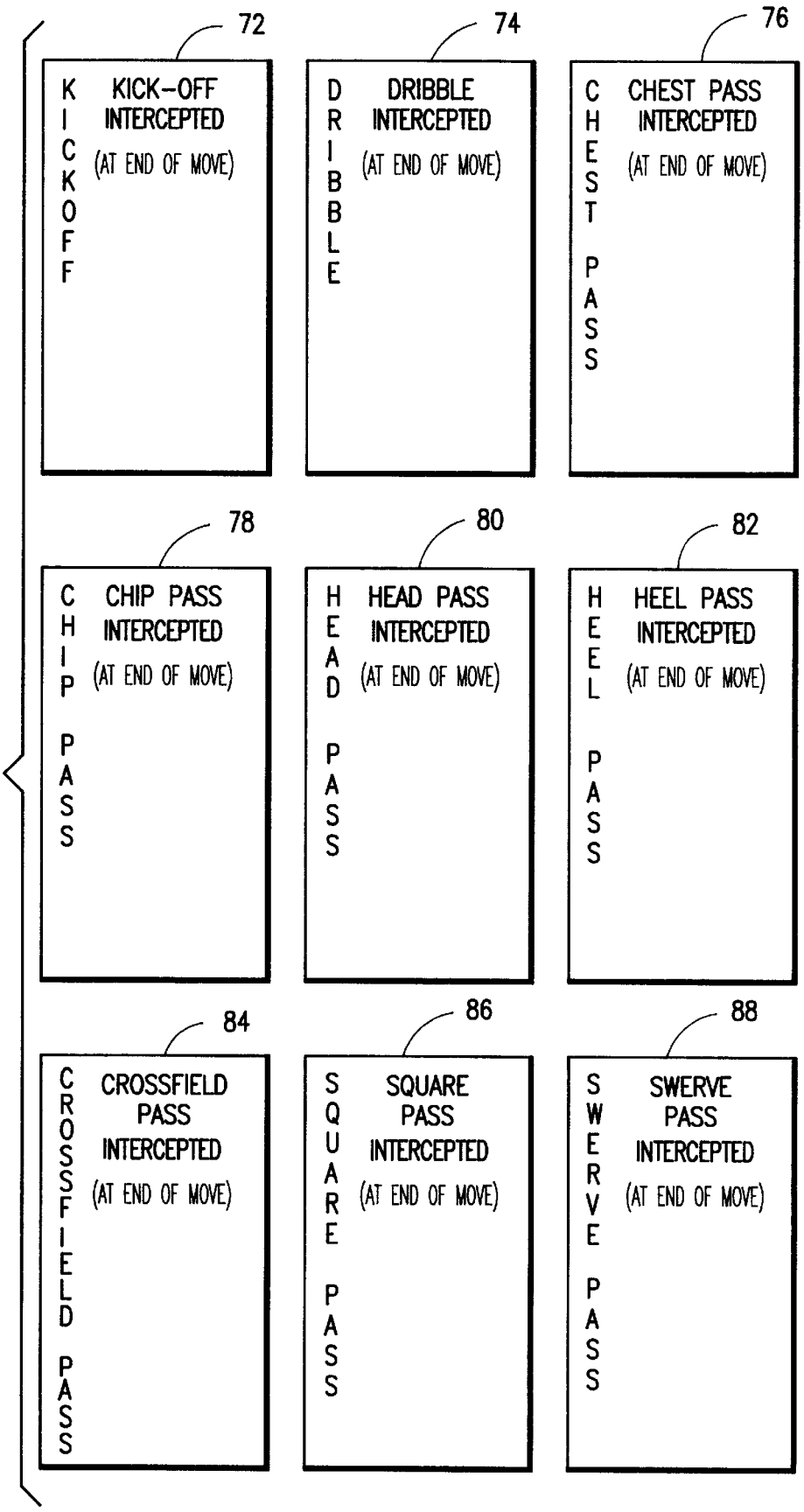
FIG. 8 is a top view of the defense cards.

In a preferred embodiment, there is provided a soccer game board 90 having a representation of a soccer field thereon including a center field area 92, two goal areas 94, and a plurality of playing positions 96. (See FIG. 1) Each of the plurality of playing positions are connected to other of the playing positions by a plurality of connecting lines 98. Any two playing positions are connected only by a single line. The playing positions include a penalty spot position 100. The plurality of connecting lines represent passing lanes. Two game pieces 102 are provided representing the goal keepers of the respective teams. (See FIG. 2) The defense team game piece is used to block the offense player's pass or kick moves primarily in the goal area. A game piece representing a game ball 104 is provided. (See FIG. 3) A tabular means 106 for recording points and penalties made by the defense player and the offense player is also used.

In a preferred embodiment, the game ball 104 can be moved by the offense player a specified number of playing positions, in accordance with instructions carried on the played card. A pass card is then played by the offense player from the offense playing hand. This is done when the defense player does not play a penalty or defense card in response to the pass card. The game ball 104 is moved by the offense player a specified number of positions, in accordance with instructions carried on the pass card. The offense player then draws a replacement card from the playing deck. In this situation, the defense player also discards a card from the defense playing hand and draws a replacement card from the playing deck.

In another preferred embodiment, the defense player plays a penalty card in response to the pass card played by the offense player. The defense player then draws a replacement card from the playing deck and the game ball 104 is turned over to the defense player, so that the defense player becomes the offense player and the offense player becomes the defense player.

In yet another preferred embodiment, the defense player can play a defense card in response to the pass card played by the offense player. The defense player then draws a replacement card from the playing deck and the game ball 104 is turned over to the defense player, so that the defense player becomes the offense player and the offense player becomes the defense player.

In a preferred embodiment, if a goal kick 18 card is played by the offense player, the offense player can move the game ball 104 in accordance with the instructions carried on the goal kick 18 card for moving the game ball 104 in a forward direction 3 to 10 playing positions.

If a corner kick 20 card is played, the offense player can move the game ball 104 in accordance with the instructions carried on the corner kick 20 card for moving the game ball 104 in a forward direction 3 to 10 playing positions.

In preferred embodiment, the opponent is awarded a direct free kick when a penalty card is played from the group consisting of kicking an opponent 22, tripping an opponent, jumping an opponent 26, charging an opponent 28, striking an opponent 30, holding an opponent 32, pushing an opponent 34, and violently charging 36.

In preferred embodiment, the opponent is awarded an indirect free kick when a penalty card is played from the group consisting of: dangerous play 38, charging an opponent 40, obstruction 42, charging goal keeper 44, time-wasting by goal keeper 46, goal keeper taking more than four steps 48, deliberately kicking ball to his goal keeper 50, and kicking the ball away after award of free kick.

Preferably, a kick-off 54 card is played to begin the game, second half or overtime period. The kick-off 54 card carries instructions for moving a game ball 104, 3 to 6 playing positions in any forward direction.

Alternatively, a dribble 56 card is played to begin the game, second half or overtime period. The dribble 56 card carries instructions for moving a game ball 104, 1 to 2 playing positions in any direction card, and the game ball 104 must move 2 playing positions when going through a defense player.

The offense player can play any pass card in the offense playing hand and move the game ball 104 according to the instructions on the card. The chest pass 58 card carries instructions for moving the game ball 104, 1 to 2 playing positions in any direction. The chip pass 60 card carries instructions for moving 2 to 3 playing positions in any direction away from a defense player.

The head pass 62 card carries instructions for moving 4 to 6 playing positions in any direction. The heel pass 64 card carries instructions for moving 1 to 2 playing positions backwards, away from a defense player. The crossfield pass 66 card carries instructions for moving as many playing positions in a straight line, between touch lines, away from a defense player. The square pass 68 card carries instructions for moving as many playing positions in straight line, between goal lines, away from a defense player. The swerve pass 70 card carries instructions for moving as many playing positions diagonally away from a defense player.

The defense player can play a defense card in response to the offense player's card selection. A kick-off intercepted 72 card can be played in response to an offense player's kick-off 54 card. A dribble intercepted 74 card can be played in response to an offense player's dribble 56 card. A chest pass intercepted 76 card can be played in response to an offense player's chest pass 58 card. A chip pass intercepted 78 card can be played in response to an offense player's chip pass 60 card.

A head pass stopped card 80 can be played in response to an offense player's head pass 62 card. A heel pass intercepted 82 card can be played in response to an offense player's heel pass 64 card. A crossfield pass intercepted 84 card can be played in response to an offense player's crossfield pass 66 card. A square pass intercepted 86 card can be played in response to an offense player's square pass 68 card. A swerve pass intercepted 88 card can be played in response to an offense player's swerve pass 70 card.

In another embodiment, there is provided a game system. The system includes a soccer game board having a representation of a soccer field thereon including a center field area, two scoring areas, and a plurality of playing positions. Each of the plurality of playing positions are connected to other of the playing positions by a plurality of connecting lines. Any two playing positions are connected only by a single line. The plurality of connecting lines represent passing lanes. A game piece is provided representing the defense team. The defense team game piece is used to block the offense player's pass or kick moves. A game piece representing a game ball 104 is provided. A tabular means for recording points and penalties made by the defense player and the offense player is also used. The system also includes a deck of kicking cards 2 and a deck of playing cards 4. At least a portion of the kicking deck and the playing deck carries instructions for their use in the progress of a soccer game. Preferably, the plurality of kicking cards 2 and penalty card are selected from the groups of cards outlined above.

EXAMPLE

The following example is meant for illustrative purposes only and in no way is intended to limit the scope of the claims.

In general the soccer board game play parallels that of the original game, with a few exceptions. Such differences are for the most part, necessitated by the requirements of a board game as opposed to actual, physical play. For example, in the true game, if a player trips or violently charges an opponent after he has been officially cautioned or booked with a yellow card he may be dismissed from the game by the referee. In this game, of course, there is no referee so this aspect of the true game would not apply here.

Arrange the game on any suitable playing surface. Place three brass pegs in their respective location on the soccer field keeping in mind that only one peg is needed to represent the ball and that this peg needs to be marked with a white stripe (white tape is supplied in game box). The other two pegs represent the goalkeepers on each side of the soccer field.

The cards can be color coded to facilitate play. A red defensive card is played against a green offensive card, unless the offensive team plays a defensive card against itself. Playing a defensive card against itself while on offense is called "clutching".

The offensive team may be "clutching" for any of several reasons for example: 1.) Offensive team may only have defensive cards in playing hand, making it necessary to play a defensive card. 2.) Offense may play a defensive card like a dribble intercepted 74 card simply to see what the next card in the playing deck will be. 3.) If the offensive team plays a defensive card (clutching), the defensive player is not allowed to discard or allowed to pick another card from the playing deck.

A coin toss is performed, the winner of which has the option described below. Deal 10 cards (face down) from the playing deck to each player. After analyzing his or her playing hand, the coin toss winner then declares whether he or she is going on offense (having possession of the ball first) or playing defense (having the next possession when starting the second half).

To start, the offensive player plays the green offensive kick-off 54 card from his or her playing hand (placing it face up in discard pile) thus leaving 9 cards in his or her playing hand.

Offensive player immediately picks up another card from playing deck to replenish his or her playing hand back to 10 cards.

If the offensive player does not have a kick-off 54 card in his or her playing hand to start the game, second half, overtime period or after a goal has been scored, one of the 12 offensive dribble cards can be used to start play.

The movement of the peg representing the ball when playing a kick-off 54 card can be played from any of the 12 peg holes in the center of the field (shaded center spot area).

After successfully playing a kick-off 54 card to get in position to play and continue the game, the offensive player plays a green offensive pass card from his or her playing hand (placing it face up in discard pile) thus leaving 9 cards in his or her playing hand. Offensive player immediately picks up another card from the playing deck to replenish his or her hand back to 10 cards.

Defensive player lets offensive player know if play is good—if not, defensive player plays the red corresponding defensive card against it or a yellow penalty card against it.

If defensive player states play is good, offensive player is allowed to move the ball (marked peg) the appropriate number of spaces or play positions specified on the pass card. Defensive player then discards any offensive, defensive or penalty card of his or her choice—such discard does not effect offensive play. A card is then drawn from playing deck to add to his or her hand.

To counter offensive play, defensive player selects red corresponding defensive card or yellow penalty card and places it face up on discard pile. Play attempted by offensive player's green card is then affected by action indicated on red card or yellow card. Defensive player draws one card from deck to add to playing hand. While on defense, you don't have to play the red corresponding card or yellow penalty card.

If defensive player plays red corresponding defensive card and the pass card is intercepted, the interception is at the end of the offensive move. If the end of the move is in the goal area the interception does not stop the goal from being scored. Play continues in like manner, in each of the two halves of the game, until all of the cards from the playing deck have been played.

Each player must have 10 cards in his or her playing hand before a play can be made and also before the coin toss winner decides whether to go on offense (having possession of the ball first) or go on defense (having the next possession when starting the second half). Each player must not have more than 10 cards in his or her playing hand.

If an offensive or defensive player already has 10 cards in his or her playing hand and then picks an 11th card, the opposing player has the opportunity to discard card from the opponent's playing hand without observing the other player's hand.

If a play is made by either the offensive or defensive player that is not in accordance with the rules of the game, it will result in that discard becoming nullified (i.e., not playable) and also result as an automatic interception, if played by offensive team. The offensive player always picks from the playing deck first after a pass card has been played. Defensive player must let opponent know if card played is good (i.e., defensive player will not play a defensive card to stop it) before defensive player discards.

When discarding after a successful play has been made, the defensive team may discard any offensive or defensive card in his or her playing hand.

At any time, when on offense, if it should be advantageous, or if you only have defensive cards in your hand, you can play defensive cards against yourself as long as they agree with the rules of the game. See strategy section of this book called 'clutching'.

Once a card is laid down and released from a player's hand, it cannot be picked back up. That card must be played out. "A card laid is a card played".

When playing a pass card no movement at right angle or left angle 90 degrees or more can be played. When playing a pass card, all moves are in a direct line by moving left, right, forward, backward, or diagonal as indicated on each pass card.

When playing a pass card the defensive player has the option of moving one of its defensive goalkeeping peg protecting its own goal, in the penalty area, one to two spaces on its side of the soccer field.

Options on which shots can be taken or played is indicated on each of the green offensive cards and there is no exception to this rule. Options on which defensive cards can be played on any green offensive cards are indicated on each of the red corresponding cards and there is no exception to this rule. Yellow penalty cards can be played on any green offensive pass cards and either a direct or indirect free kick is awarded.

The deck containing the kicking hand and penalty hand is shuffled at the beginning of each half (or when all cards in the deck have been played)

Playing Deck: after all the cards in this deck have been played, a half has ended and the cards will then be reshuffled for the next half At the end of the first half, the remaining cards in each player's hand will be returned to the deck to be reshuffled to start anew for the second half.

When a card needs to be played from the kicking hand to correspond and in accordance with the rules of the game, you keep drawing or playing each card from the kicking hand until the appropriate play can be made like a direct free kick good 10 card or direct free kick no good 14 card is played after a penalty card has been played against a green offensive pass card or the offensive player has played against itself in a "clutching" situation. All penalty kicks are played from the penalty spot on the field.

A yellow penalty card with a direct free kick being awarded can only be played on a green offensive pass card when the ball (marked peg) is in the opponent's penalty area.

After a yellow penalty card has been played on a green offensive pass card, play is re-started with a free kick being played by the offensive player. The kick will either be direct or indirect depending on the penalty card being played.

A goal can be scored by drawing a direct free kick good 10 card from the kicking hand without playing another green offensive play card.

A goal can only be scored from an indirect free kick by first playing a green offensive pass card then drawing or playing an indirect free kick good 12 card from the kicking hand. When an offensive pass card has been played and the end of the move results into an out of bounds play, the appropriate kick card from the kicking hand must be played in accordance with the rules of the real game.

The goal kick 18 card is used when the ball (marked peg) crosses the goal line (except when it goes in the goal itself) and was last played by an offensive pass card. A goal kick 18 card starts play in the space and position of the goalkeeper peg.

The corner kick 20 card is used when the ball (marked peg) crosses the goal line (except when it goes in the goal itself) and was last played by a defensive pass intercepted card. A corner kick 20 card starts play in the space or position directly in front of the corner of the field where the ball (marked peg) went out of bounds.

When the ball (marked peg) crosses either touch line the next offensive pass card is played from the space or position where it goes out of bounds. This play is called a throw in and the player that last played an offensive pass card or defensive intercepted pass card, before the (marked peg) crosses the touch line, throws it back into play by playing a green offensive pass card.

Time-out can only be called and played before a play is made. Your opponent cannot call time-out after you have made a play. Each player can only call two time-outs for each half of the game. One time-out by each player can be called in each overtime period. When a player calls time-out, the opposing player has the option to take a break without a time-out being charged or recorded to him.

When an overtime occurs because the score is tied after all of the cards in the playing deck have been played, the playing deck will be reshuffled.

To start the overtime, 50 playing cards from the shuffled playing deck will be used for each overtime period and procedures in the General Rules are repeated. The overtime period constitutes two halves of 50 playing cards from the shuffled playing deck.

If the score is still tied after the overtime period a 'penalty shoot-out' will occur. In such a shoot-out each team takes five penalty kicks by playing or drawing from the kicking hand until a penalty kick good 6 card or penalty kick no good 8 card has been drawn and played with an offensive and defensive player taking each kick in turn. If this fails to separate the teams and the score is still tied, they continue taking alternate penalty kicks until one team gains the advantage.

What is claimed is:

1. A method of a playing game comprising the steps of providing a deck of kicking cards and a deck of playing cards, wherein at least a portion of the kicking deck and the playing deck carries instructions for their use in the progress of a soccer game;

dealing a like plurality of cards from the playing deck to each of two players;

declaring an offense player and a defense player, wherein the plurality of cards dealt to the offense player are an offense playing hand and the plurality of cards dealt to the defense player are a defense playing hand;

wherein the plurality of kicking cards are selected from the group consisting of:
penalty kick good,
penalty kick no good,
direct free kick good,
indirect free kick good,
direct free kick no good,
indirect free kick no good,
goal kick, and
corner kick;

wherein the playing deck comprises penalty cards, offense playing cards, and defense playing cards, and wherein the penalty cards are selected from the group consisting of:
kicking an opponent,
tripping an opponent,
jumping an opponent,
charging an opponent,
striking an opponent,
holding an opponent,
pushing an opponent,
violently charging, dangerous play,
charging an opponent,
obstruction,
charging goal keeper,
time-wasting by goal keeper,
goal keeper taking more than four steps,
deliberately kicking ball to his goal keeper, and
kicking the ball away after award of free kick;

wherein the offense playing cards are selected from the group consisting of
kick-off,
dribble,
chest pass,
chip pass,
head pass,
heel pass,
crossfield pass,
square pass,
swerve pass, wherein the defense playing cards are selected from the group consisting of:
kick-off intercepted,
dribble intercepted,
chest pass intercepted,
chip pass intercepted,
head pass stopped,
heel pass intercepted,
crossfield pass intercepted,
square pass intercepted,
swerve pass intercepted;

playing a card selected from the group consisting of a kick-off card and a dribble card from the offense playing hand; and drawing a replacement card from the playing deck, wherein the replacement card is drawn by the offense player;

said method further comprising the steps of playing a penalty card from the playing deck, wherein the penalty card is played by the defense player and awards a kick to the defense player; and then displaying cards from the kick deck until a result for the kick awarded to the defense player is obtained.

2. A method as in claim 1, further comprising:

providing a soccer game board having a representation of a soccer field thereon including a center field area, two goal areas, and a plurality of playing positions, wherein each of said plurality of playing positions is connected to other of the playing positions by a plurality of connecting lines, wherein any two playing positions are connected only by a single line, said plurality of playing positions including a penalty shot position, wherein the plurality of connecting lines represent passing lanes;

providing a plurality of game pieces representing goal keepers for the offense player and the defense player, wherein the game pieces can be moved by the player a selected number of playing positions without the use of the playing deck;

providing a game piece representing a game ball; and providing a tabular means for recording points and penalties made by the defense player and offense player.

3. A method as in claim 2, further comprising the steps of:

moving the game ball a specified number of playing positions, in accordance with instructions carried on the played card; wherein the game ball is moved by the offense player;

playing a pass card from the offense playing hand, wherein the pass card is played by the offense player;

moving the game ball a specified number of positions, in accordance with instructions carried on the pass card, wherein the game ball is moved by the offense player;

drawing a replacement card from the playing deck, wherein the replacement card is drawn by the offense player;

discarding a card from the defense playing hand, wherein the card is discarded by the defense player; and drawing a replacement card from the playing deck, wherein the replacement card is drawn by the defense player.

4. A method as in claim 3, further comprising the steps of: playing a chest pass card, wherein the chest pass card carries instructions for moving 1 to 2 playing positions in any direction away from a defense player.

5. A method as in claim 3, further comprising the steps of: playing a chip pass card, wherein the chip pass card carries instructions for moving 2 to 3 playing positions in any direction away from a defense player.

6. A method as in claim 3, further comprising the steps of: playing a head pass card, wherein the head pass card carries instructions for moving 4 to 6 playing positions in any direction.

7. A method as in claim 3, further comprising the steps of: playing a heel pass card, wherein the heel pass card carries instructions for moving 1 to 2 playing positions backwards, away from a defense player.

8. A method as in claim 2, further comprising the steps of: playing a kick-off card, wherein the kick-off card carries instructions for moving a game ball 3 to 6 playing positions in any forward direction.

9. A method as in claim 2, further comprising the steps of: playing a dribble card, wherein the dribble card carries instructions for moving a game ball 1 to 2 playing positions in any direction card, wherein the game ball must move 2 playing positions when going through a defense player.

10. A method as in claim 2, further comprising the steps of:

playing a penalty card in response to the pass card played by the offense player, wherein the penalty card is played by the defense player;

drawing a replacement card from the playing deck, wherein the replacement card is drawn by the defense player; and turning the game ball over to the defense player, wherein the defense player becomes the offense player and the offense player becomes the defense player.

11. A method as in claim 2, further comprising the steps of:

playing a defense card in response to the pass card played by the offense player, wherein the defense card is played by the defense player;

drawing a replacement card from the playing deck, wherein the replacement card is drawn by the defense player; and turning the game ball over to the defense player, wherein the defense player becomes the offense player and the offense player becomes the defense player.

12. A method as in claim 11, further comprising the steps of: playing a crossfield pass card, wherein the crossfield pass carries instructions for moving as many playing positions in a straight line, between touch lines, away from a defense player.

13. A method as in claim 11, further comprising the steps of: playing a square pass card, wherein the square pass card carries instructions for moving as many playing positions in straight line, between goal lines, away from a defense player.

14. A method as in claim 11, further comprising the steps of: playing a swerve pass card, wherein the swerve pass card carries instructions for moving as many playing positions diagonally away from a defense player.

15. A method as in claim 11, further comprising the steps of: playing a kick-off intercepted card in response to an offense player's kick-off card.

16. A method as in claim 11, further comprising the steps of: playing a dribble intercepted card in responsive to an offense player's dribble card.

17. A method as in claim 11, further comprising the steps of: playing a chest pass intercepted card in response to an offense player's chest pass card.

18. A method as in claim 11, further comprising the steps of: playing a chip pass intercepted card in response to an offense player's chip pass card.

19. A method as in claim 11, further comprising the steps of: playing a head pass stopped card in response to an offense player's head pass card.

20. A method as in claim 11, further comprising the steps of: playing a heel pass intercepted card in response to an offense player's heel pass card.

21. A method as in claim 11, further comprising the steps of: playing a crossfield pass intercepted card in response to an offense player's crossfield pass card.

22. A method as in claim 11, further comprising the steps of: playing a square pass intercepted card in response to an offense player's square pass card.

23. A method as in claim 11, further comprising the steps of: playing a swerve pass intercepted card in response to an offense player's swerve pass card.

24. A method as in claim 2, further comprising the steps of: playing a goal kick card, wherein the goal kick carries instructions for moving the game ball in a forward direction 3 to 10 playing positions.

25. A method as in claim 2, further comprising the steps of: playing a corner kick card, wherein the corner kick card carries instructions for moving the game ball in a forward direction 3 to 10 playing positions.

26. A method of playing a game comprising the steps of:

providing a soccer game board having a representation of a soccer field thereon including a center field area, two goal areas, and a plurality of playing positions, wherein each of said plurality of playing positions is connected to other of the playing positions by a plurality of connecting lines, wherein any two playing positions are connected only by a single line, said plurality of playing positions including a penalty shot position, wherein the plurality of connecting lines represent passing lanes;

providing a plurality of game pieces representing goal keepers for the offense player and the defense player, wherein the game pieces can be moved by the player a selected number of playing positions without the use of the playing deck;

providing a game piece representing a game ball;

providing a tabular means for recording points and penalties made by the defense player and offense player;

providing a deck of kicking cards and a deck of playing cards, wherein at least a portion of the kicking deck and the playing deck carries instructions for their use in the progress of a soccer game;

dealing a like plurality of cards from the playing deck to each of two players;

declaring an offense player and a defense player, wherein the plurality of cards dealt to the offense player are an offense playing hand and the plurality of cards dealt to the defense player are a defense playing hand;

wherein the plurality of kicking cards are selected from the group consisting of penalty kick good, penalty kick no good, direct free kick good, indirect free kick good, direct free kick no good, indirect free kick no good, goal kick, and corner kick;

wherein the playing deck comprises penalty cards, offense playing cards, and defense playing cards, wherein the penalty cards are selected from the group consisting of kicking an opponent, tripping an opponent, jumping an opponent, charging an opponent, striking an opponent, holding an opponent, pushing an opponent, violently charging, dangerous play, charging an opponent, obstruction, charging goal keeper, time-wasting by goal keeper, goal keeper taking more than four steps, deliberately kicking ball to his goal keeper, and kicking the ball away after award of free kick;

wherein the offense playing cards are selected from the group consisting of kick-off, dribble, chest pass, chip pass, head pass, heel pass, crossfield pass, square pass, and swerve pass;

and wherein the defense playing cards are selected from the group consisting of kick-off intercepted, dribble intercepted, chest pass intercepted, chip pass intercepted, head pass stopped, heel pass intercepted, crossfield pass intercepted, square pass intercepted, swerve pass intercepted;

playing a card selected from the group consisting of a kick-off card and a dribble card from the offense playing hand;

and drawing a replacement card from the playing deck, wherein the replacement card is drawn by the offense player;

said method further comprising the steps of awarding the opponent a direct free kick when a penalty card is played from the group consisting of kicking an opponent, tripping an opponent, jumping an opponent, charging an opponent, striking an opponent, holding an opponent, pushing an opponent, and violently charging; and then displaying cards from the kick deck until a result for the direct free kick is obtained.

27. A method of playing a game comprising the steps of providing a soccer game board having a representation of a soccer field thereon including a center field area, two goal areas, and a plurality of playing positions, wherein each of said plurality of playing positions is connected to other of the playing positions by a plurality of connecting lines, wherein any two playing positions are connected only by a single line, said plurality of playing positions including a penalty shot position, wherein the plurality of connecting lines represent passing lanes;

providing a plurality of game pieces representing goal keepers for the offense player and the defense player, wherein the game pieces can be moved by the player a selected number of playing positions without the use of the playing deck;

providing a game piece representing a game ball;

providing a tabular means for recording points and penalties made by the defense player and offense player;

providing a deck of kicking cards and a deck of playing cards, wherein at least a portion of the kicking deck and the playing deck carries instructions for their use in the progress of a soccer game;

dealing a like plurality of cards from the playing deck to each of two players;

declaring an offense player and a defense player, wherein the plurality of cards dealt to the offense player are an offense playing hand and the plurality of cards dealt to the defense player are a defense playing hand;

wherein the plurality of kicking cards are selected from the group consisting of penalty kick good, penalty kick no good, direct free kick good, indirect free kick good, direct free kick no good, indirect free kick no good, goal kick, and corner kick;

wherein the playing deck comprises penalty cards, offense playing cards, and defense playing cards, wherein the penalty cards are selected from the group consisting of kicking an opponent, tripping an opponent, jumping an opponent, charging an opponent, striking an opponent, holding an opponent, pushing an opponent, violently charging dangerous play, charging an opponent, obstruction, charging goal keeper, time-wasting by goal keeper, goal keeper taking more than four steps, deliberately kicking ball to his goal keeper, and kicking the ball away after award of free kick;

wherein the offense playing cards are selected from the group consisting of kick-off, dribble, chest pass, chip pass, head pass, heel pass, crossfield pass, square pass, and swerve pass;

and wherein the defense playing cards are selected from the group consisting of kick-off intercepted, dribble intercepted, chest pass intercepted, chip pass intercepted, head pass stopped, heel pass intercepted, crossfield pass intercepted, square pass intercepted, swerve pass intercepted;

playing a card selected from the group consisting of a kick-off card and a dribble card from the offense playing hand;

and drawing a replacement card from the playing deck, wherein the replacement card is drawn by the offense player;

said method further comprising the steps of awarding the opponent an indirect free kick when a penalty card is played from the group consisting of dangerous play, charging an opponent, obstruction, charging goal keeper, time-wasting by goal keeper, goal keeper taking more than four steps, deliberately kicking ball to his goal keeper, and kicking the ball away after award of free kick;

and then displaying cards from the kick deck until a result for the indirect free kick is obtained.

* * * * *